United States Patent [19]

Umemura et al.

[11] Patent Number: 4,844,621

[45] Date of Patent: Jul. 4, 1989

[54] FUEL PUMP WITH PASSAGE FOR ATTENUATING NOISE GENERATED BY IMPELLER

[75] Inventors: Koji Umemura, Aichi; Toru Nakashima, Kariya; Yoshifumi Ina, Okazaki; Masashi Miyamoto, Kariya, all of Japan

[73] Assignee: Nippondenso Co., Ltd., Kariya, Japan

[21] Appl. No.: 230,685

[22] Filed: Aug. 10, 1988

Related U.S. Application Data

[63] Continuation of Ser. No. 894,894, Aug. 8, 1986, abandoned.

[30] Foreign Application Priority Data

| | | | |
|---|---|---|---|
| Aug. 10, 1985 | [JP] | Japan | 60-176244 |
| Mar. 17, 1986 | [JP] | Japan | 61-58991 |
| May 20, 1986 | [JP] | Japan | 61-117036 |

[51] Int. Cl.[4] ..... F04D 29/66

[52] U.S. Cl. ..... 415/119; 415/55.5; 415/169.1; 415/1

[58] Field of Search ..... 415/119.53 T, 213 T, 415/168, 121 A, 198.2

[56] References Cited

U.S. PATENT DOCUMENTS

| | | | |
|---|---|---|---|
| 3,881,839 | 5/1975 | MacManus | 415/53 T |
| 3,947,149 | 3/1976 | MacManus | 415/213 T |
| 4,466,781 | 8/1984 | Kemmner et al. | 415/213 T |
| 4,508,492 | 4/1985 | Kusakawa et al. | 415/53 T |
| 4,538,958 | 9/1985 | Takei et al. | 415/53 T |
| 4,586,877 | 5/1986 | Watanabe et al. | 415/213 T |
| 4,591,311 | 5/1986 | Matsuda et al. | 415/53 T |

FOREIGN PATENT DOCUMENTS

| | | |
|---|---|---|
| 79193 | 5/1985 | Japan . |
| 113088 | 6/1985 | Japan . |
| 219495 | 11/1985 | Japan . |

*Primary Examiner*—Robert E. Garrett
*Assistant Examiner*—John T. Kwon
*Attorney, Agent, or Firm*—Cushman, Darby & Cushman

[57] ABSTRACT

A fuel pump of regenerative type mounted in a fuel tank. The fuel pump has a pump housing defining a pump chamber, an impeller rotatably mounted in the pump housing and provided with a multiplicity of blades formed thereon, and a driving device for driving the impeller. The fuel pump further has a vapor relief port for relieving, from the pump chamber into the space in the fuel tank, vapor of fuel generated as a result of rotation of the impeller, and a vapor relief extension passage connected to the vapor relief port and opening at least one end in the space in the fuel tank.

21 Claims, 11 Drawing Sheets

FUEL PUMP WITH PASSAGE FOR ATTENUATING NOISE GENERATED BY IMPELLER

This is a continuation of application Ser. No. 894,894, filed Aug. 8, 1986, which was abandoned upon the filing hereof.

BACKGROUND OF THE INVENTION

The present invention relates to a fuel pump of regenerative type, adapted to be mounted in the fuel tank of, for example, an automobile. More particularly, the invention is concerned with an improvement in the fuel pump provided with a relief port for fuel vapor.

Generally, a fuel pump of this kind has a pump chamber and an impeller which cooperates with this pump chamber. A vapor relief port is disposed in the fuel pump so as to provide a communication between the interior and the exterior of the pump chamber. With this arrangement, any vapor fraction of the fuel generated in the pump chamber during running of the pump is discharged through the vapor relief port to the outside of the pump, thereby preventing deterioration of the fuel supplying performance of the pump which may otherwise be caused by vapor lock. Such a regenerative type fuel pump with a vapor relief port is disclosed in, for example, in the specification of the U.S. Pat. No. 4,538,958 to Takei et al, as well as in the specifications of U.S. Pat. Application Ser. No. 639,434 filed on Aug. 10, 1984, now U.S. Pat. No. 4,591,311 and U.S. patent application Ser. No. 671,309 on Nov. 14, 1984, the latter three of which have been assigned to the same assignee as that of the present application.

This type of fuel pump encounters a problem that the noise generated by the impeller during the running of the pump is amplified by the fuel tank and then transmitted to the outside of the tank.

Nowadays, in vehicles such as automobiles, technology has achieved a remarkable progress also in the field of suppression of noises from, for example, the engine so as to realize higher level of silence in the compartment of the vehicle. The amplified noise from the fuel pump, therefore, is annoying particularly for the passengers on the rear seats in the compartment. The noise from the fuel pump is attributable to various factors such as sliding contact between the impeller and the pump housing, pulsation of the fuel caused by the impeller blades and so forth.

In order to obviate this problem, it has been done to enhance the mechanical precision between the pump wall and the impeller. It has been proposed also to arrange the blades of the impeller at an irregular pitch so as to reduce the level of the noise produced by the impeller blades, as in U.S. Pat. No. 3,947,148. The latter method, however, is disadvantageous in that the pump performance is adversely affected by the fundamental change of the construction of the impeller. It has thus been difficult to suppress the generation of noise satisfactorily without deteriorating the pump performance.

SUMMARY OF THE INVENTION

Accordingly, an object of the invention is to provide a fuel pump which can sufficiently lower the level of the noise from a fuel pump, without being accompanied by a deterioration of the pump performance.

Another object of the invention is to provide a fuel pump which is capable of sufficiently attenuating the noise generated by the impeller of a fuel pump, before the noise is transmitted to the outside of the fuel tank.

Still another object of the invention is to provide a fuel pump which can effectively reduce the noise from the impeller by adopting a comparatively simple construction.

To these ends, according to the invention, there is provided a regenerative type fuel pump having vapor relief port means which provides a communication between the interior and the exterior of the pump chamber, characterized by comprising vapor relief extension passage means which is connected at its one end to the vapor relief port and opening at its other end to a fuel tank.

The present invention is based upon the following analysis on the causes of the noise from the fuel pump of the type described, conducted by the inventors. Namely, the noise from the fuel pump is mainly attributable to the pumping action performed by the impeller in the pump chamber. Therefore, the vapor relief port, which provides a communication between the pump chamber and the interior of the fuel tank and, hence, constituting a passage of the noise transmission from the fuel pump to the passengers, has a great significance from the view point of noise attenuation. More specifically, the vapor and liquid fractions of the fuel relieved from the vapor relief port into the fuel tank involve vibratory noise components of the fuel, and these noise components are transmitted to the passengers. The vibratory noise component carried by the vapor and liquid fuel fractions have frequencies which are produces of the rotation speed of the impeller and the number of the impeller blades, i.e., proportional to the number of pumping cycles per second. The principal vibratory noise component has, when the pump is operating with sufficient pumping performance, a comparatively high frequency which generally ranges between about 3 KHz and 5 KHz.

According to the invention, the noise generated in the pump chamber is transmitted to the outside of the pump chamber as the noise is carried by the vapor and, if any, liquid fuel which are relieved through the vapor relief port means. The vapor and the liquid fuel, however, do not directly reach the space in the fuel tank but travel along the vapor relief extension passage means before they reach the space in the fuel tank. Thus, according to the invention, the length of the passage of communication between the pump chamber and the fuel tank is increased by virtue of the provision of the vapor relief extension passage means. In consequence, the noise components carried by the vapor and the liquid fuel are sufficiently attenuated during the travel of the vapor and liquid fuel along the long vapor relief port means and vapor relief extension passage means. Therefore, the escape of the noise to the space in the fuel tank is effectively suppressed so as to remarkably reduce the level of the noise reaching the passengers ears.

These and other objects, features and advantages of the invention will become clear from the following description of the preferred embodiments taken in conjunction with the accompanying drawings.

DESCRIPTION OF THE PREFERRED EMBODIMENT

Before turning to the description on the embodiments of the invention a conventional fuel pump of the type to which the invention pertains will be explained with specific reference to FIGS. 17 and 18.

Figure 17:
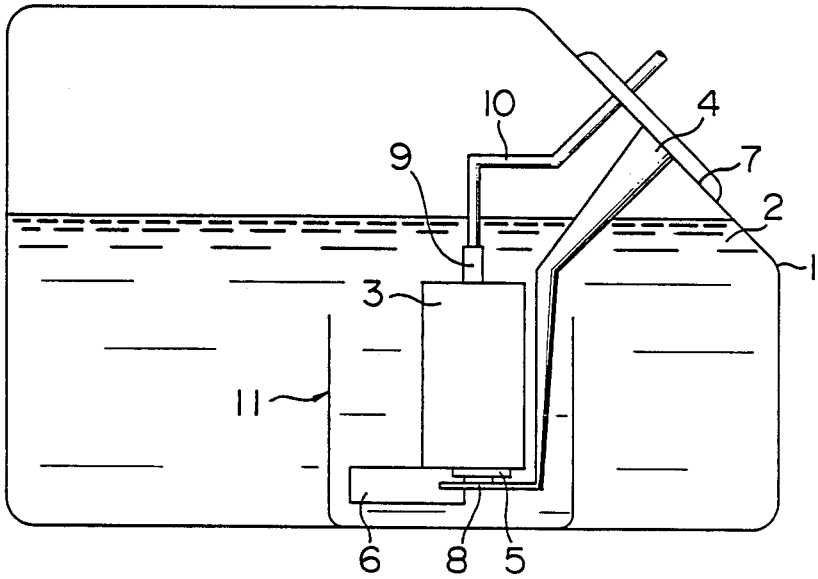
FIG. 17 PRIOR ART
FIG. 17 is a schematic illustration of a conventional fuel pump mounted in a fuel tank.

FIG. 17 shows a conventional fuel pump in the state mounted in a fuel tank. More specifically, a regenerative type fuel pump 3 is situated through a metallic holder 4 in an automotive fuel tank 1 which is filled with a fuel 2. A cushion rubber 5 interposed between the fuel pump 3 and the metallic holder 4 prevents the vibration of the fuel pump from being transmitted to the holder 4. A filter 6 is connected to the suction port of the fuel pump 3. The holder 4 is secured at its upper end to a cover 7 of a fuel tank 1 while the lower end 8 of the holder 4 is flattened so as to contact the cushion rubber 5. A delivery pipe 10 connected to the delivery portion 9 of the fuel pump 3 extends to the exterior of the fuel tank through the tank cover 7. The tank cover 7 is made of a metallic material and is detachably fixed to the fuel tank through, for example, bolts. The fuel pump 3 and the filter 6 are encased by a small-sized sub-tank 11.

Figure 18:
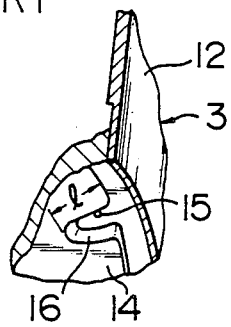
FIG. 18 PRIOR ART
FIG. 18 is a perspective view of an essential part of the conventional fuel pump as viewed from the lower side thereof.

FIG. 18 is an illustration of a part of the bottom of the fuel pump shown in FIG. 17 as viewed from the lower side of the pump. The fuel pump 3 has a cylindrical housing 12 which in turn is made of a metallic material such as aluminum or an iron sheet. A pump housing 14 constituting a pump chamber is secured to the lower end of the cylindrical housing 12. As stated before, the bottom of the pump housing 14 is adapted to contact the cushion rubber 5.

The pump housing 14 is provided with a vapor relief port 15 which is formed in the housing wall so as to provide a communication between the interior and the exterior of the pump chamber. The vapor relief port 15 is located in a recessed portion 16 formed in the bottom of the pump housing 14. The recess 16 is intended for avoiding blockage of the vapor relief port 15 by the cushion rubber 5. Therefore, vapor of fuel generated in the pump chamber is relieved directly into the space of the recess 16 through the vapor relief port 15 and then discharged to the right as viewed in FIG. 18. The size "l" of the recess 16 shown in FIG. 18 is on the order of 5 mm in the case of an automotive fuel pump, so that the vapor from the pump chamber is relieved into the space in the fuel tank without delay.

Figure 1:
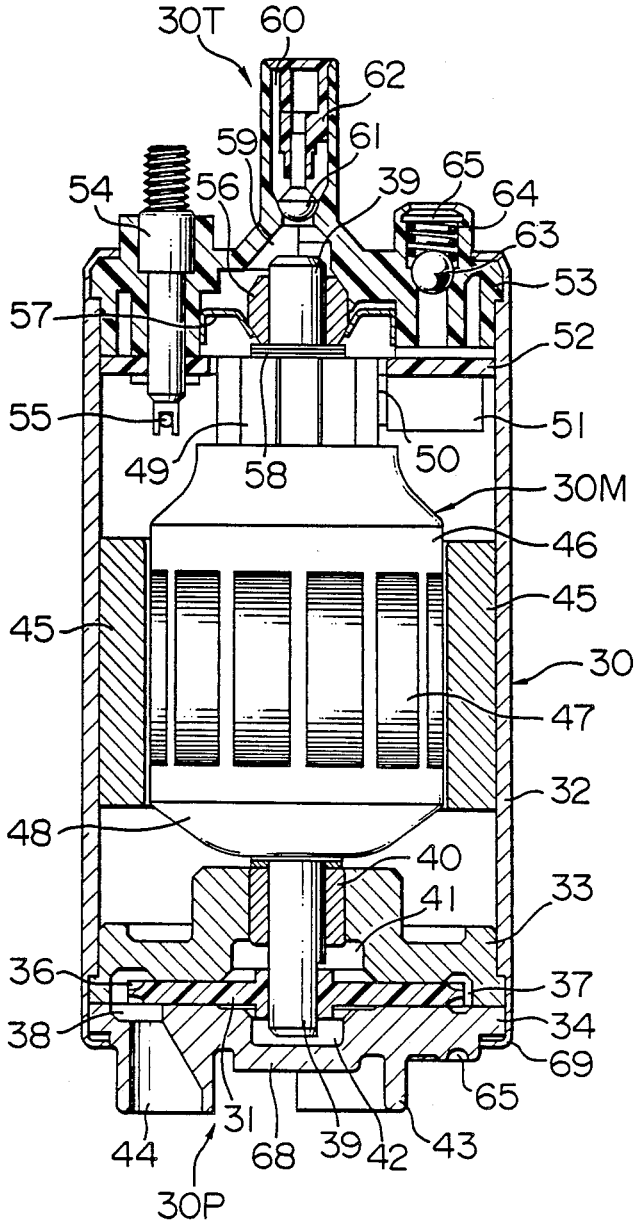
FIG. 1 is a vertical sectional view of the fuel pump in accordance with the first embodiment of the invention, taken along the line I—I of FIG. 2.

The first embodiment of the invention will be explained hereinunder with reference to FIGS. 1 to 4. Referring first to FIG. 1, a fuel pump 30 is constituted by a pump section 30P, a motor section 30M and a terminal section 30T all of which are encased by a cylindrical housing 32.

The pump portion 30P is disposed in the lower portion of the housing 32, and is provided with an impeller 31 made of a synthetic resin. The pump impeller 31 is of so-called regenerative type, having a multiplicity of blades 36 on a disk-shaped main part. The pump section 30P includes a pump cover 33 and a pump housing 34 both of which are made of aluminum. The pump housing 34 and the pump cover 33 are assembled together through a cylindrical housing 32 such that they define therebetween a pump chamber 37. The pump impeller 31 is rotatably received in the pump chamber 37 so as to define a flow passage 38 along the periphery thereof, and is coupled to a motor shaft 39.

A reference numeral 49 designates a motor bearing carried by the pump cover 33 and having a recess 41 formed therein. A recess 42 is formed also in the center of the pump housing 34. The pump housing 34 has a bottom which is provided with a pump housing protrusion 43 and a suction port 44 connected to the flow passage 38 of the pump chamber.

A motor section 30M on the pump section 30P includes a field magnet 45, a rotor 46 with a motor shaft 39, and an armature 47, so as to operate as a D.C. magnet motor. As is well known, the armature 47 is provided with slots (not shown) receiving armature coil windings. A reference numeral 48 designates a resin-molded portion which fills up the slots of the armature core 47 so as to embed the armature coil windings, while smoothing the outer peripheral surface of the rotor 46, thereby reducing the loss of energy due to agitation of the ambient fluid. A commutator 49 contacted by brushes 50 is disposed in a brush holder 51. A numeral 52 designates a brush holder made of a synthetic resin. As explained before, the motor shaft 39 is coupled to the impeller 31 of the pump section 30P so that the impeller 31 is driven by the motor.

On the other hand, a terminal section 30T is disposed on the opposite side of the motor section 30M to the pump section 30P, and has a terminal housing 53. This terminal housing 53 is made of a synthetic resin, and metallic terminals 54 extend to the outside of the terminal housing through the wall of the latter. Electric power is supplied to the brushes 50 through leads 55 which are connected to the terminals 54. The motor shaft 39 is supported by a self-centering bearing 56.

A bearing support plate 57 made of a resilient material is secured to the inner peripheral surface of the terminal housing 53, so as to support the self-centering bearing 56. The bearing support plate 57 has a disk-like form and is provided with a multiplicity of holes which constitute passages for the fuel. A reference numeral 58 designates a thrust washer mounted on the motor shaft.

A fuel delivery passage 59 and a fuel delivery port 60 communicating with the passage 59 are formed in the wall of the terminal housing 53. The delivery port 60 receives a check valve with a valve member 61 held by a holder sleeve 62. A relief valve employing a ball-type valve member 63 is provided on the wall of the terminal housing 53. The valve member 63 is usually urged into contact with a valve seat formed on the wall of the terminal housing 53, by means of a coiled spring 64 which is retained by a retainer 65.

Figure 2:
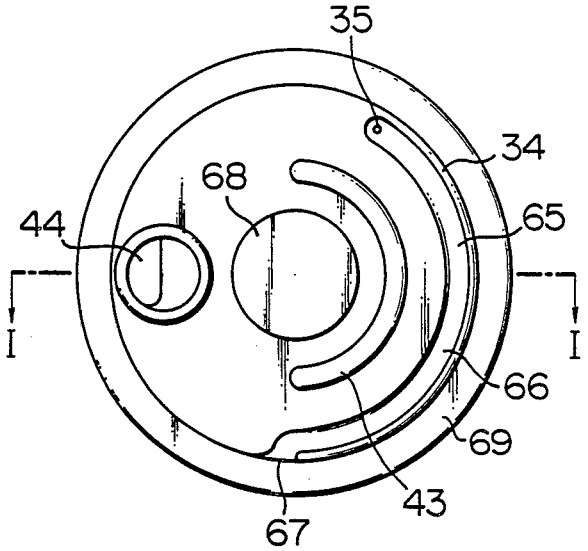
FIG. 2 is a bottom plan view of the fuel pump shown in FIG. 1.

Referring now to FIG. 2 showing the bottom of the fuel pump 30, the pump housing 34 has a vapor relief port 35 which provides a communication between the interior and the exterior of the pump chamber 37, so as to relief any vapor of fuel generated in the pump chamber 37. The vapor relief port 35 is a fine hole formed in the wall of the pump housing by drilling after the formation of the pump housing.

The vapor relief port 35 is communicated with a groove 65 formed in the bottom of the pump housing 34 and having a width slightly greater than the diameter of the vapor relief port 35. The groove 65, which is formed in the bottom surface of the pump housing 34, extends in a curvature along the bottom surface of the pump housing over about one-third ($\frac{1}{3}$) of the circumference as shown in FIG. 2, thus constituting a part of the vapor relief extension passage 66. The groove 65 has an end reaching a step on the outer periphery of the pump housing 34. This end of the groove 65 constitutes a vapor outlet opening of the vapor relief extension passage 66. The direction of in which the groove 65 extends from the vapor relief port 35 to the vapor outlet opening 67 coincides with the direction of rotation of the impeller 31. In FIG. 2, a reference numeral 68 denotes a protrusion formed on the center of the pump housing, while 69 designates a caulked portion of the cylindrical housing.

Figure 3:
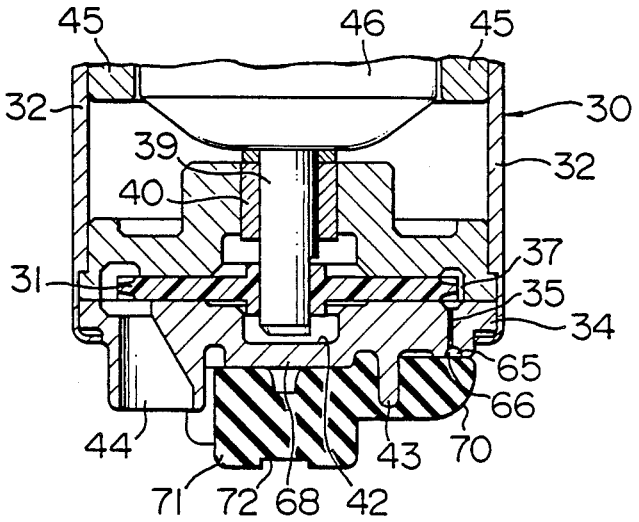
FIG. 3 is a fragmentary vertical sectional view of the fuel pump taken along the line III—III of FIG. 4, illustrating a cushion rubber mounted in the bottom of the fuel pump.
Figure 4:
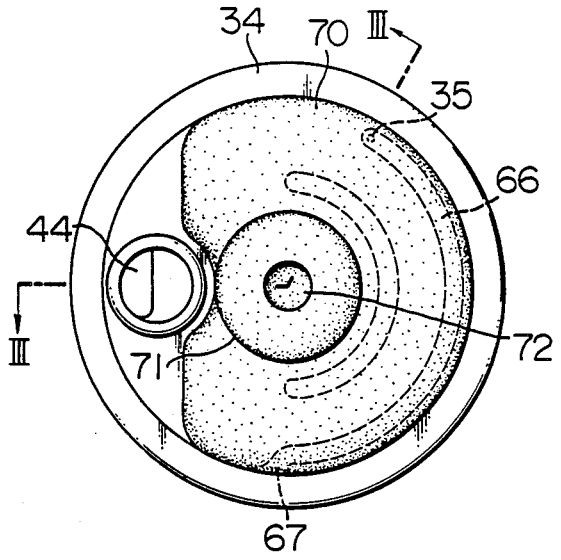
FIG. 4 is a bottom plan view of the fuel pump with the cushion rubber mounted thereon.

As will be seen from FIGS. 3 and 4, the fuel pump 30 of this embodiment is provided with a cushion rubber 70 which has a recess receiving the pump housing protrusion 43. The cushion rubber 70 covers the entire length of the groove 65 shown in FIG. 2, so that the vapor relief extension passage 66 in a tunnel-like form is formed by a cooperation between the groove 65 and the cushion rubber 70. Therefore, the fuel vapor emitted from the vapor relief port 35 formed in the pump housing 34 is required to travel along this long vapor relief extension passage 66 before it reaches the vapor outlet opening 67 from which it is relieved into the space in the fuel tank.

Referring now to FIG. 4, the cushion rubber 70 is provided with a cushion rubber central protrusion 71 on the center thereof, and a cushion rubber central recess 72 formed in the center of the protrusion 71. As will be seen from this Figure, the cushion rubber 70 has a substantially semi-circular form and covers the bottom of the pump housing 34 so as to clear the suction port 44. The cushion rubber 70 effectively prevents the vibration of the fuel pump 30 from being transmitted to the metallic holder contacting the bottom surface of the cushion rubber.

The operation of this embodiment is as follows. As the rotor 46 starts to rotate by the electric power supplied to the motor section in the fuel pump, the impeller 31 rotates to pump the fuel. When the impeller rotates, noise if generated by the blades 36 on the outer peripheral portion of the impeller. An investigation conducted by the present inventors proved that the noise has frequency components of comparatively high frequencies, proportional to the product of the number of the blades 36 on the impeller 31 and the rotation speed of the latter, i.e., the number of pumping cycles performed in the pump chamber 37 per second. The major frequency component amounting to the product of the number of the impeller blades and the rotation speed of the impeller will be referred to as "primary impeller frequency".

As the impeller 31 rotates, the fuel is displaced in the pump chamber 37. Namely, the fuel sucked through the suction port 44 flows towards the delivery section through a substantially C-shaped passage 38 formed around the impeller 31 in the pump chamber 37. Although not shown, this delivery section includes a delivery passage which is provided in the pump cover 33. The fuel in the pump chamber 37 is introduced into the motor section 30 M. That is, the fuel which has passed through the pump chamber 37 flows across the pump cover 33 and reaches the area around the rotor 46, and then flows through the gap between the rotor 46 and the magnet 45. The fuel further flows into the delivery passage 59 part the through holes in the bearing support plate 57 and is discharged outside the fuel tank through the through a discharge pipe (not shown) past the pump discharge port 60 by lifting the check valve 61.

As the impeller 31 rotates at a high speed within the pump chamber 37, a part of the fuel is changed into vapor. When the volume of the fuel vapor is increased, the fuel pump becomes unable to pump up the fuel despite the rotation of the impeller 31, due to a phenomenon known as "vapor lock". The vapor relief port 35 providing a communication between the pump chamber 37 and the fuel tank is provided for this purpose. The vapor generated in the pump chamber 37 is relieved through this port 35 and reaches the vapor relief extension passage 66 formed by the groove 65 and the cushion rubber 70. Thus, the fuel vapor and accompanying liquid fuel which have passed the vapor relief port 35 reach the vapor outlet opening 67 through the vapor relief extension passage 66. The noise component carried by the fuel vapor and liquid fuel is sufficiently attenuated as the vapor and liquid fuel travel a long distance along the vapor relief extension passage 66 from the vapor relief port 35.

It is to be understood that the present invention is based upon the following analytical result attained by the inventors. Insofar as the fuel pump of the kind described is concerned, the major path of transmission of the noise from the pump impeller to the passenger in the compartment is the path of the fuel vapor through the vapor relief port which provides a communication between the pump chamber and the space in the fuel tank. Namely, a significant portion of the noise which annoys the passenger is conveyed by the fuel vapor and the liquid fuel which are relieved from the vapor relief port.

It is also to be pointed out that the noise generated in the pump chamber includes the component of the impeller primary frequency which is comparatively high. In the field of acoustic engineering, it is well known that a sound (vibration) of a high frequency can be attenuated by increasing the innertance $m$ which is given by the following equation:

$$m=\rho l/S$$

where, S represents the area of the passage, $\rho$ represents the fluid density and $e$ represents the length of the passage.

In the embodiment described above, the noise component carried by the vapor and the liquid fuel discharged from the pump chamber into the space in the fuel tank is attenuated during the travel along the long path of a small cross-section constituted by the vapor relief port 35 and the vapor relief extension passage 66. In order to prevent any deterioration of the pumping performance, i.e., the pressure rise in the pump chamber 37 of the fuel pump, the vapor relief port 35 has a cross-sectional area which is selected to be very small. In addition, in order to permit a quick discharge of the vapor, the length of the vapor relief port is selected to be as small as possible. It is, therefore, materially impossible to sufficiently attenuate the noise component carried by the fuel vapor and the liquid fuel discharged from the pump chamber 37 into the space in the fuel tank, solely by the vapor relief port 35. In view of this fact, according to the invention, the vapor extension passage 66 is connected to the vapor relief port 35. The cross-sectional area and the length of this vapor relief passage 66 are selected such that the noise component carried by the vapor and the fuel is sufficiently attenuated without causing any restriction on the flow of the vapor and the liquid fuel into the space in the fuel tank.

The present inventors have confirmed that the noise component can be attenuated sufficiently if the total length of the path constituted by the vapor relief port and the vapor relief extension passage is 15 mm or greater, when the vapor relief port as well as the vapor relief extension passage has a diameter of about 0.9 mm.

In the described embodiment, however, the vapor relief extension passage 66 has a cross-sectional area greater than that of the vapor relief port 35, in order to ensure a quick relief of the fuel vapor into the space in the fuel tank and also to permit an easy connection of the vapor extension passage to the vapor relief port 35. In order to attain a sufficiently high noise attenuation effect with this extension passage of a large diameter, the extension passage is made to have a length increased correspondingly to the cross-sectional area, so as to obtain a sufficiently high innertance $m$.

The first embodiment described hereinbefore has an advantage that the vapor relief extension passage can be formed without requiring any additional part because the wall of this passage is partly constituted by the cushion rubber which is used also in the conventional fuel pump of the type described. In addition, the cushion rubber 70 absorbs a significant portion of the noise component carried by the fuel vapor and liquid fuel coming from the vapor relief port, thus contributing to the reduction in the noise level. The fuel vapor and the fuel component from the vapor relief passage 66 also contains a kinetic energy which is imparted thereto by the action of the impeller 31. In the described embodiment, since the direction of the vapor relief extension passage 66 coincides with the direction of rotation of the impeller 31, the fuel vapor and the fuel smoothly flow along the vapor relief extension passage 66 towards the opening 67, i.e., in the direction of action of the kinetic energy.

The effect of the first embodiment will be explained hereinunder with reference to FIGS. 5 and 6 which show, respectively, the noise characteristics of the conventional device shown in FIG. 17 and the noise characteristics of the first embodiment. In each of these Figures, the axis of abscissa represents the primary impeller frequency which corresponds, as explained before, to the number of pumping cycles performed by the impeller in the pump chamber 37 per second, i.e., to the product of the number of the blades on the impeller 31 and the rotation speed of the impeller. The pumps employed in the experiment for obtaining the characteristics shown in FIGS. 5 and 6 had impellers of closed-blade type having 57 blades on each side. Since the blades are arranged on both sides of the impeller such that the blades are aligned in the axial direction, the number of pumping cycles corresponds to the number of blades on one side of the impeller 31. The reason why the primary impeller frequency is chosen as the axis of abscissa is that the noise component of this frequency constitutes almost whole of the annoying noise from the pump and the evaluation of the noise suppression effect can be conducted most suitably by measuring the level of this frequency component. The axis of ordinate, therefore, represents the level of the noise component of the primary impeller frequency. The experiment was conducted by measuring the level of this noise component by means of a microphone disposed at the position of ears of the passenger on the rear seat, while varying the speed of the motor for driving the pump by a variable voltage source. The motor speed was gradually increased in the range of the ordinary pump operating speed so as to gradually increase the primary pump frequency. The level of the noise was detected by the microphone and the noise component of the primary impeller frequency, which is most annoying as explained before, was picked-up from among various noise components through a filter, thus extracting the primary impeller noise in relation to the motor speed, whereby the characteristics as shown in FIGS. 5 and 6 were obtained.

Figure 5:
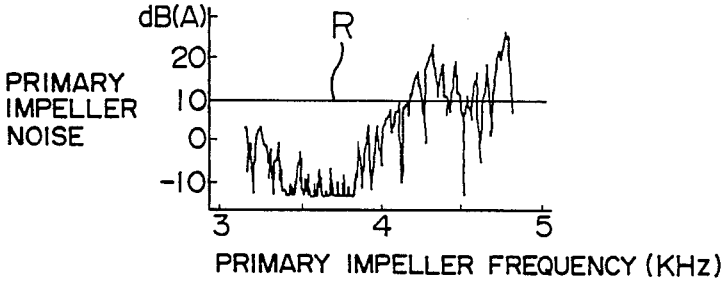
FIGS. 5 and 6 are diagrams showing, in comparison, the impeller noise characteristics of a conventional fuel pump and the fuel pump of the first embodiment.
Figure 6:
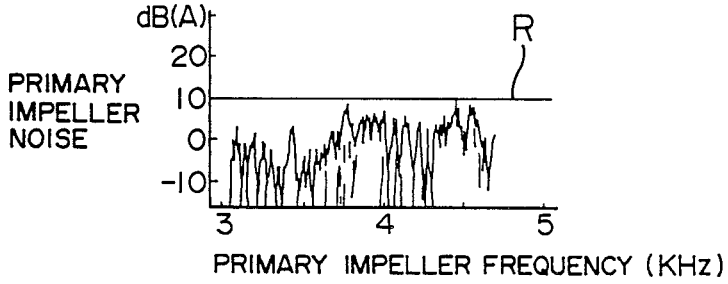

From a comparison between FIGS. 5 and 6, it will be understood that a remarkable reduction in the primary impeller noise within the ordinary speed range of the fuel pump, which is 3 to 5 KHz in terms of frequency, has been achieved by the fuel pump of the invention over the conventional fuel pump. In FIGS. 5 and 6, R represents the reference level employed for the purpose of facilitating the comparison.

As will be understood from the foregoing description, in the first embodiment of the invention, the pulsating component relieved from the vapor relief port 35, i.e., the noise component carried by the fuel vapor and the liquid fuel, is transmitted to the space in the fuel tank after attenuation along the vapor relief extension passage. In fact, a noise suppression by 5 to 10 dB was attained when the motor is driven within the ordinary pump operating range by a source battery voltage of around 13.2 V.

In the first embodiment described hereinbefore, the vapor relief port 35 is constituted by a small hole of a diameter on the order of 0.9 mm and the groove 65 is a semi-circular groove has a diameter of about 3 mm and formed in the bottom surface of the pump housing 34 which is diecast from aluminum. The impeller 31 is of so-called closed blade type with 114 blades in total on both sides of the impeller. As the impeller 31 rotates, the fuel is pumped by the action of the impeller blades so that pulsation of a frequency corresponding to the pumping frequency is imparted to the fuel, and this pulsation is the cause of the noise. In the first embodiment described hereinbefore, this pulsation of the fuel vapor and the liquid fuel is attenuated as the fuel vapor and the liquid fuel flows through the vapor relief port 35 and the vapor relief extension passage 66, in accordance with the innertance which is determined by the cross-sectional area of the path and the length of the same.

The groove 65 need not always have a curvature along the periphery of the pump housing. Namely, the groove 65 can be extended linearly in any direction other than the radial direction of the pump housing.

Other embodiments of the invention will be explained hereinafter. The following description, however, will be focussed mainly on the points which discriminate respective embodiments from the first embodiment, omitting the detailed explanation on the same portions as those of the first embodiment which are denoted by the same reference numerals.

Figure 7:
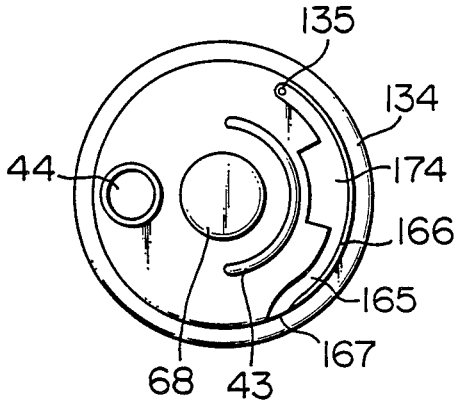
FIG. 7 is a bottom plan view of the pump housing of the fuel pump in accordance with the second embodiment of the invention.

FIG. 7 shows the bottom surface of the second embodiment of the fuel pump in accordance with the invention. This embodiment has a vapor relief port 135 and a groove 165 formed in the bottom surface of the pump housing and having a width greater than the radius of the vapor relief port 135. The groove 165 has an enlarged intermediate portion 174. The fuel vapor from the vapor relief port 135 reaches the vapor outlet port 135 along the vapor relief extension passage 166 constituted by the groove 165 with the enlarged intermediate portion. In this embodiment, the vapor relief extension passage 166 is formed by a cooperation between the groove 165 and the cushion rubber 70, as in the case of the first embodiment. Thus, the second embodiment features the enlarged intermediate portion 174 of the groove 165, which sufficiently attenuates also the frequency components other than the primary impeller frequency component, so that a further suppression of the noise reaching the passenger can be attained.

Figure 8:
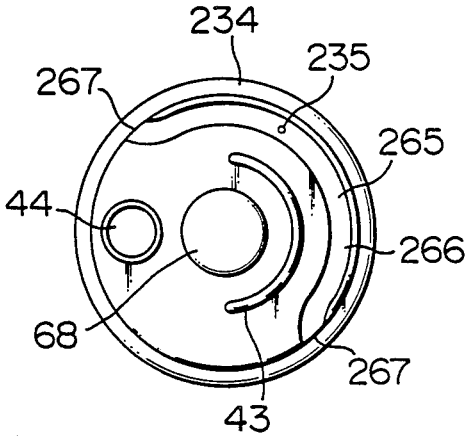
FIG. 8 is a bottom plan view of the pump housing of the fuel pump in accordance with the third embodiment of the invention.

FIG. 8 shows the third embodiment of the invention in which grooves 265, each being similar to the groove in the first embodiment, are disposed on both sides of the vapor relief port 235. In consequence, a pair of vapor outlet openings 267 are formed on the bottom surface of the pump housing 234. The vapor relief extension passages 266 are formed by the cooperation between the grooves 265 and the cushion rubber 70, also in this embodiment.

Figure 9:
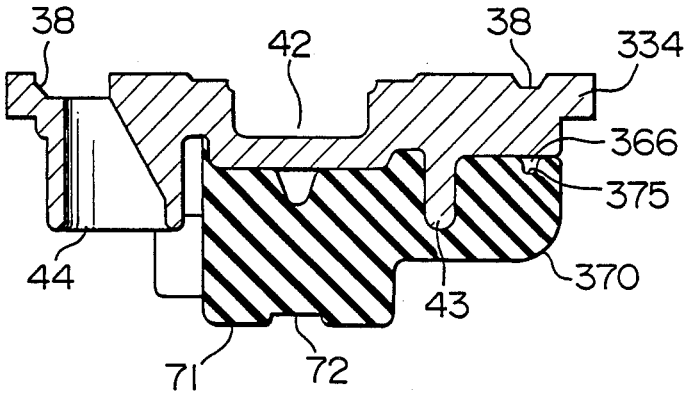
FIG. 9 is a fragmentary vertical sectional view of the fuel pump according to the fourth embodiment of the invention, illustrating particularly the pump housing and the cushioning rubber mounted therein.

FIG. 9 shows the fourth embodiment in which a groove 375 is formed in the surface of the cushion rubber 370 simultaneously with the formation of the cushion rubber 370. That is, no groove is formed in the pump housing 334. Thus, the vapor relief extension passage 366 is formed by the groove 375 in the cushion rubber 370 and the surface of the bottom wall of the pump housing 334, as the cushion rubber 370 is attached to the pump housing 334. In operation, the fuel vapor from the vapor relief port is made to flow through the vapor relief extension passage 336 and is discharged into the space in the fuel tank through a vapor outlet opening (not shown) which is disposed on the end of the vapor relief extension passage 366.

Figure 10:
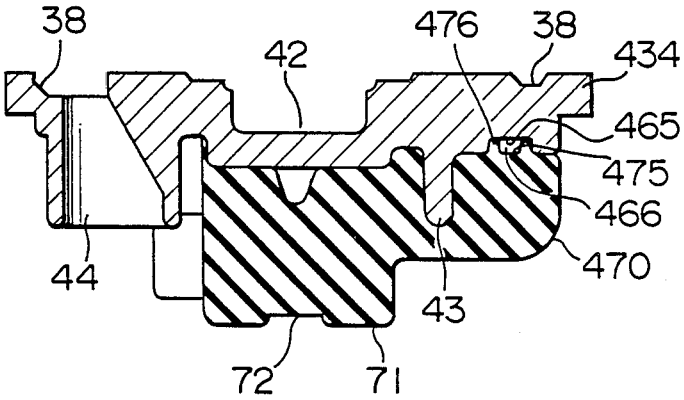
FIG. 10 is a fragmentary vertical sectional view of an essential portion of the fuel pump in accordance with the fifth embodiment of the invention.

FIG. 10 shows the fifth embodiment which is basically the same as the fourth embodiment. That is, a groove is formed in the cushion rubber 470. More specifically, the cushion rubber 470 is provided on both sides of the groove with rubber tongues 476 which defin the groove 475. The tongues 476 are received in a corresponding groove 465 formed in the pump housing 434. Thus, a vapor relief extension passage 466 is constituted by a combination between the groove 475 defined by the rubber tongues 476 and the groove 465 formed in the pump housing 434. In this embodiment, the rubber tongues 476 provides a tight seal along the vapor relief extension passage 466 down to the vapor outlet opening (not shown), so that the vapor relieved from the vapor relief port can be introduced without fail to the vapor outlet opening.

Figure 11A:
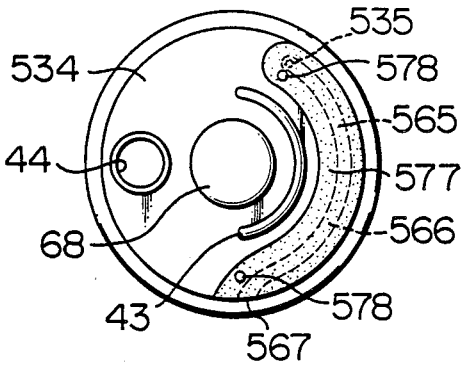
FIGS. 11*a* and 11*b* are a bottom plan view of a pump housing and an elevational view of the pump housing of the fuel pump in accordance with the sixth embodiment of the invention.
Figure 11B:
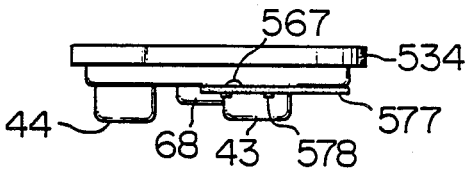

The sixth embodiment will be explained with reference to FIGS. 11*a* and 11*b*. FIG. 11*a* is a bottom plan view of the pump housing of the sixth embodiment of the fuel pump in accordance with the invention, while FIG. 11*b* is an elevational view of the sixth embodiment. As will be understood from the broken line shown in FIG. 11*a*, a pump housing 534 is provided with a vapor relief port 535 and a groove 565 similar to those in the first embodiment. In addition, a thin resin plate 577 having an arcuate form corresponding to the form of the groove 565 is fixed to the bottom surface of the pump housing 534 so as to cover the groove 565, so that a vapor relief extension passage 566 is formed by a cooperation between the groove 565 and the resin plate 577. Thus, in the sixth embodiment, the tunnel-like vapor relief extension passage 566 leading from the vapor relief port 535 to the vapor outlet opening 567 is formed by making use of the arcuate flat plate 577, unlike the foregoing embodiments which make use of the cushion rubber. A reference numeral 578 denotes a rivet by which the plate 577 is fixed to the pump housing 534.

Figure 12A:
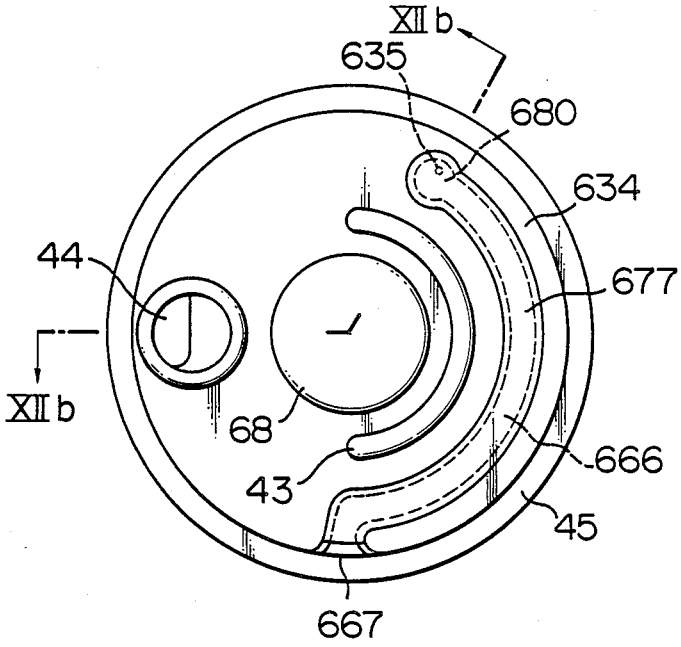
FIGS. 12*a* and 12*b* are a bottom plan view of a pump housing and a vertical sectional view of the pump housing of the fuel pump in accordance with the seventh embodiment of the invention.
Figure 12B:
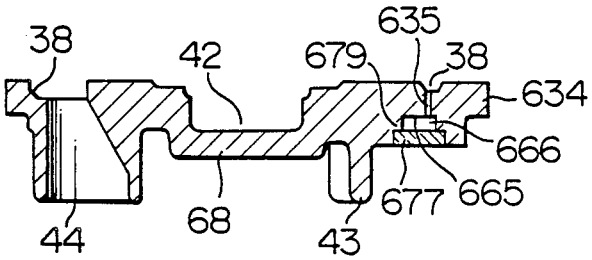

A description will be made hereinunder as to the seventh embodiment with reference to FIGS. 12*a* and 12*b*. In this embodiment, similarly to the case of the sixth embodiment, the vapor relief extension passage is formed by a groove 665 formed in the bottom of the pump housing 634 by means of an arcuate flat plate 677 made of aluminum. In the described embodiment, the flat plate 677 is installed in the groove 665 by being fitted in the groove 665 and then being caulked partially. Thus, the flat plate 677 is fixed to the surface of the pump housing 634 in such a manner as not to project from the plane of the surface of the pump housing. To this end, the surface of the pump housing has steps 679 of a depth equal to the thickness of the flat plate 677, on both sides of the groove 665, so that the flat plate 677 is received by these steps 679 when fixed in the groove 665, in such a manner that the flat plate 677 and the groove 665 in combination form a vapor relief extension passage 666. The end of the groove 665 at which it is connected to the vapor relief port 635 has the form of a circle of a diameter slightly greater than the width of the groove 665 leading to the vapor outlet opening 667. Therefore, fuel vapor and the accompanying liquid fuel, which have reached the vapor relief extension passage 666, is once led to the ample chamber in the end 680 of the vapor relief extension passage 666 and is relieved into the space in the fuel tank through the vapor outlet opening 667 after restricted by the vapor relief extension passage 666.

Figure 13A:
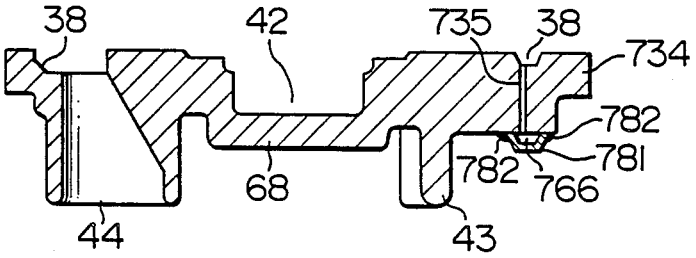
FIGS. 13*a* and 13*b* are fragmentary vertical sectional view of a pump housing and a perspective view of a cover mounted on the pump housing of the fuel pump in accordance with the eighth embodiment of the invention.
Figure 13B:
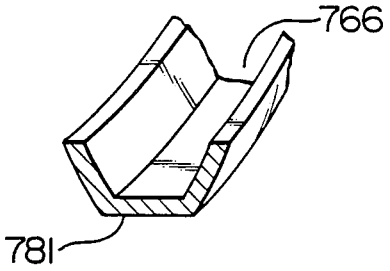

The eighth embodiment of the invention will be explained hereinunder. Referring to FIG. 13*a*, a vapor relief port 735 is formed in a pump housing 734 and is connected to a vapor relief extension passage 766. An arcuate metal cover 781 is beforehand formed to have a C-shaped cross-section as shown in FIG. 13*b*. This cover 781 is disposed on the portion of the pump housing where the vapor extension passage 766 is to be formed, and is fixed to the pump housing by spot welding along a weld line 782, thereby to form a tunnel-like vapor relief extension passage 766 along which the fuel vapor and the accompanying liquid fuel from the vapor relief port 735 are discharged into the space in the fuel tank.

Figure 14:
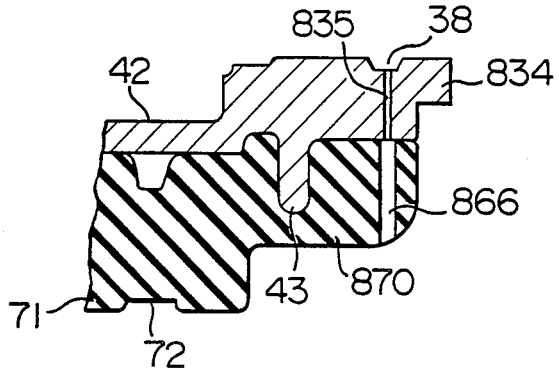
FIG. 14 is a fragmentary vertical sectional view of the fuel pump in accordance with the ninth embodiment of the invention, illustrating particularly a cushion rubber mounted thereon.

FIG. 14 shows the ninth embodiment of the invention in which a vapor relief port 835 is formed across the wall of the pump housing 834 in communication with a fuel passage 38 defined in the pump chamber. A bore which constitutes a vapor relief extension passage 866 is formed through the wall of the cushion rubber 870 so as to communicate with the vapor relief port 835 coaxially therewith.

In the ninth embodiment, the fuel vapor in the fuel passage 38 is introduced through the vapor relief port 835 into the vapor relief extension passage 866 constituted by the bore formed in the cushion rubber 870. In consequence, the pulsating component carried by the fuel vapor and the accompanying liquid fuel are attenuated and suppressed by the rubber wall of the bore constituting the vapor relief extension passage, whereby the level of the noise transmitted to the outside is suppressed remarkably.

Figure 15A:
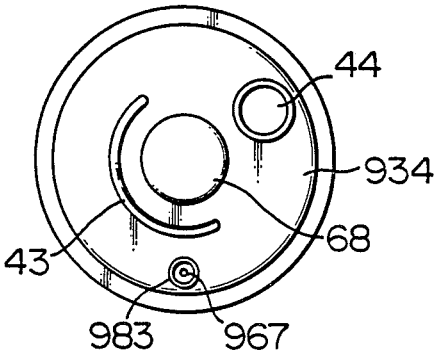
FIGS. 15*a* and 15*b* are a bottom plan view of a pump housing and an elevational view of the pump housing of the fuel pump in accordance with the tenth embodiment of the invention.
Figure 15B:
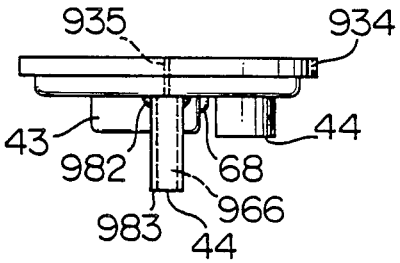

FIGS. 15*a* and 15*b* in combination constitute the tenth embodiment in which a metallic tubular extension 983 is provided integrally with the pump housing 934 of the fuel pump, coaxially with the vapor relief port 935. The bore in the tubular extension 983, having a diameter slightly greater than the diameter of the vapor relief port 935, constitutes a vapor relief extension passage 966. The tubular extension 983 may be fixed to the pump housing 934 by welding as at 982. The pulsating component carried by the fuel vapor and accompanying liquid fuel from the vapor relief port and constituting the cause of the noise is attenuated while the fuel vapor and the liquid fuel flow along the vapor relief extension passage in the tubular extension 983 towards the vapor outlet opening 967, whereby the generation of noise is suppressed remarkably.

Figure 16:
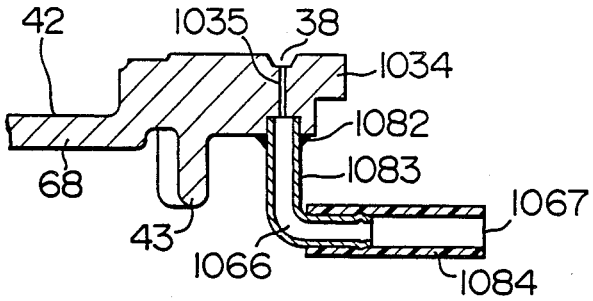
FIG. 16 is a vertical sectional view of a pump housing of the fuel pump in accordance with the eleventh embodiment of the invention.

Referring now to FIG. 16, the eleventh embodiment of the fuel pump in accordance with the invention has a tubular extension 1083 which is constituted by an L-shaped metallic pipe having an inside diameter slightly greater than that of the vapor relief port 1035. The L-shaped metallic pipe is fixed to the pump housing 1034 by welding as at 1082. In addition, a resin tube 1084 is fixed to the end of the tubular extension 1083. In this embodiment, therefore, the internal passage of the tubular extension 1983 and the internal passage of the resin tube 1084 constitute the vapor relief extension passage 1066. Therefore, the pulsating component carried by the fuel vapor and the liquid fuel is attenuated not only in the tubular extension 1983 but also in the resin tube 1084 which is highly elastic, before the fuel vapor and the liquid fuel reach the vapor outlet opening 1067. In the embodiments described hereinbefore, the pulsating component carried by the fuel vapor and the liquid fuel, constituting the cause of the noise, is attenuated while the fuel vapor and the liquid fuel flow through the vapor relief port and the vapor relief extension passage. If the length of the path including the vapor relief port and the vapor relief extension passage is extremely small, the pulsating component cannot be attenuated sufficiently even if the cross-sectional area of the vapor relief passage is selected to be as small as that of the vapor relief port. Practically, when only the attenuation of the pulsating component is taken into consideration, the total length of the path constituted by the vapor relief port and the vapor relief extension passage is preferably greater than 15 mm.

Generally, the length of the vapor relief port is about 7 mm at the greatest, in case of ordinary automotive fuel pumps. Therefore, the length of the vapor relief extension passage should be selected to be at least 8 mm. It has been confirmed also that the noise attenuation effect is saturated when the total length of the path reaches a certain value, and no appreciable improvement in the noise attenuation effect is attainable even when the total length is increased beyond this certain value.

Usually, the vapor relief port is designed to have a small cross-sectional area and a small length, in order to meet both the requirements for the smooth discharge of the fuel vapor into the space in the fuel tank from the pump chamber and for the satisfactory pressure rise in the pump chamber. Therefore, according to the invention, the vapor relief extension passage is preferably designed to have a cross-sectional area which is several times as large as the vapor relief extension passage so as to allow a smooth flow of the vapor, and to have a length which is large enough to provide an inertance m sufficient for attenuating the noise component, despite the increased length of the passage, thus ensuring both the smooth discharge of the vapor and attenuation of the noise.

Ideally, when the vapor relief port has an inside diameter of 0.9 mm and a length of about 3 mm, the vapor relief extension passage has a cross-sectional area which is several times as large as that of the vapor relief port and a length of about 25 mm, in order to attain both a sufficient noise attenuation effect and smooth relief of the fuel vapor. Thus, the vapor relief passage is preferably designed to have a cross-sectional area and the length falling within the ranges mentioned above, while taking into consideration also other factors concerning the arrangement around the fuel pump.

Although in the described embodiments the outlet opening of the vapor relief extension passage is disposed in the vicinity of the bottom of the fuel pump, the outlet opening may be disposed in the upper portion of the fuel tank. In the latter case, due to the fact that air propagates much less sound as compared with liquids, higher noise attenuation effect can be attained.

The twelfth embodiment of the invention, in which the outlet opening of the vapor extension passage is disposed in the upper portion of the fuel tank, will be explained hereinunder with reference to FIGS. 19 to 22.

Figure 19:
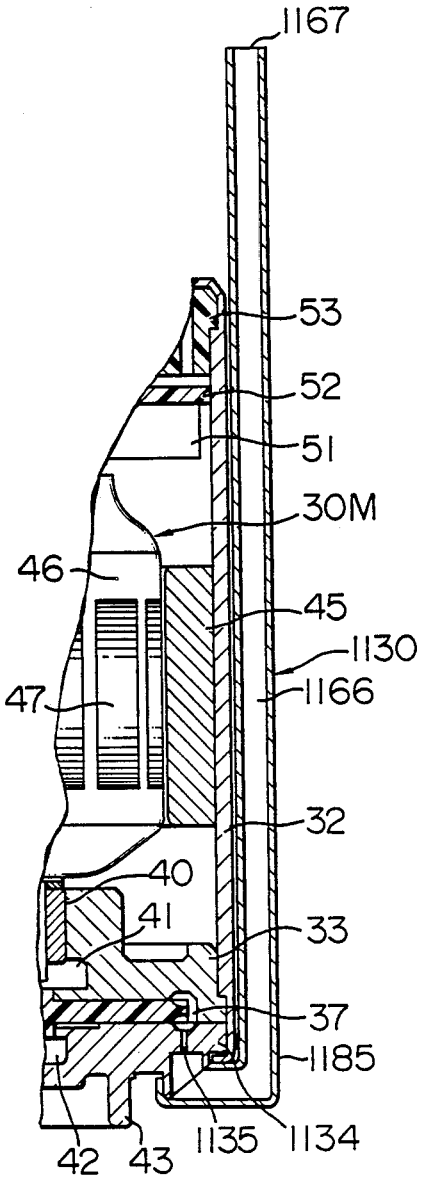
FIG. 19 is a fragmentary vertical sectional view of the fuel pump in accordance with the twelfth embodiment of the invention.

Referring first to FIG. 19, a reference numeral 1135 denotes a vapor relief port which is provided in the pump housing of the fuel pump. An iron pipe 1185 is fixed to the pump housing 1134 so as to communicate with the vapor relief port 1135. In this embodiment, the pipe 1185 has a length of about 160 mm and is extended upwardly along the side wall of the fuel pump, thereby constituting a vapor relief extension passage 1166.

Figure 20:
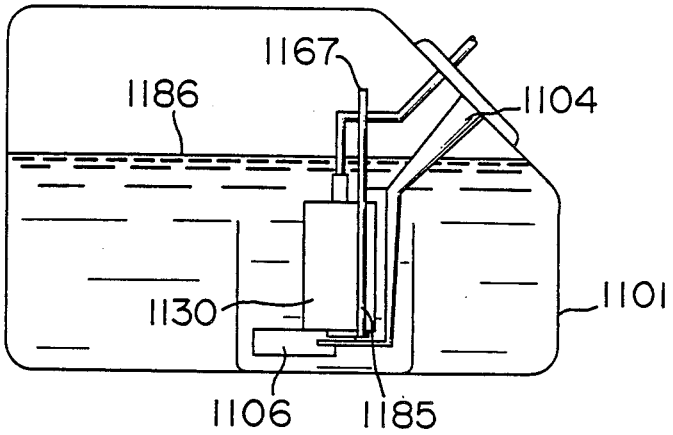
FIG. 20 is a schematic illustration of the fuel pump of FIG. 19 in the state of being mounted in a fuel tank.

FIG. 20 shows the manner in which the fuel pump 1130 in accordance with the twelfth embodiment is mounted on the fuel tank.

As will be clear from this Figure, the fuel pump 1130 is held in the fuel tank 1101 through a holder 1104, as in the case of the conventional pump and the pumps of the foregoing embodiments. In FIG. 17, a reference numeral 1167 denotes an outlet opening of a pipe 1185, while a numeral 1186 denotes the fuel level in the fuel tank. A fuel filter 1106 is secured to the suction port of the fuel pump.

In this embodiment also, the impeller noise generated in the pump chamber is carried by the fuel vapor and the accompanying liquid fuel and is transmitted through the vapor relief port 1135. Unlike the foregoing embodiments in which the noise is emitted to the bottom area of the fuel tank, the noise is introduced upward through the pipe 1185. When the fuel level 1186 is below the position of the outlet opening 1167, therefore, the fuel vapor and the accompanying liquid fuel and, hence, the impeller noise carried by the vapor and liquid fuel, are emitted not into the liquid fuel but into the air in the upper portion of the space in the fuel tank. In such a case, since the propagation of sound through air is much smaller than that through liquids, the transmission of the noise to the outside of the tank is prevented almost completely, thus attaining a remarkable noise suppression effect. On the other hand, when the fuel tank is full so that the fuel level is above the outlet opening 1167, the vapor, fuel and the impeller noise are emitted into the liquid fuel in the tank. In this case, the noise suppression effect is small as compared with the case where the fuel level is below the outlet opening, but is still appreciable because the sound pressure is less significant when the sound source is far from the wall than when the same is near to the wall.

Figure 21:
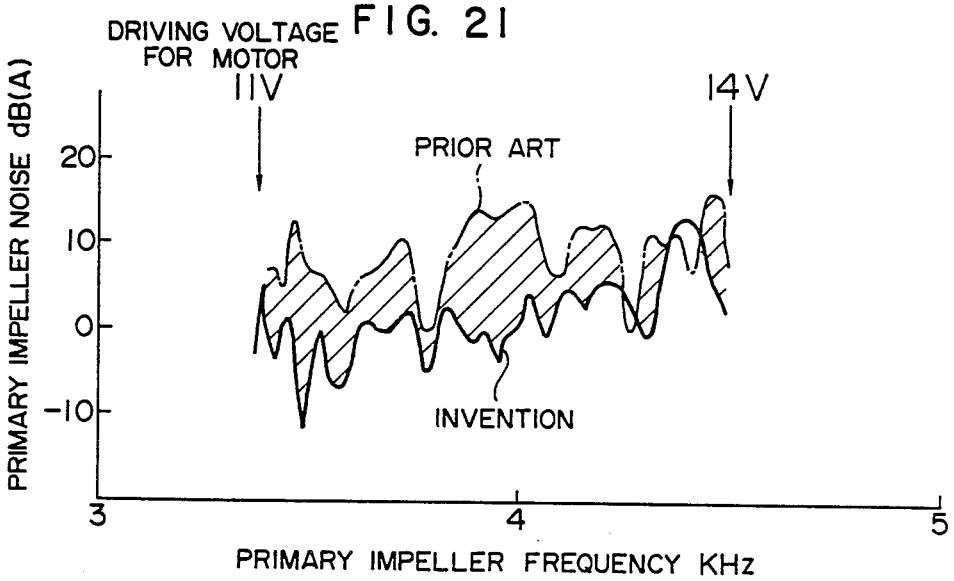
FIG. 21 is a diagram showing the impeller noise characteristic of the fuel pump shown in FIG. 19 in comparison with that of a conventional fuel pump.

FIG. 21 shows the result of an experiment which was conducted for the purpose of confirming the noise suppression effect produced by this embodiment of the invention when the fuel level 1186 is below the position of the vapor outlet opening 1167. The experiment was conducted by measuring the noise by means of a microphone fixed on the center of the rear seat of the passenger's compartment while continuously varying the terminal voltage of the fuel pump from 11 V to 14 V in 100 seconds. The motor speed was gradually increased as the voltage was increased, so that the primary frequency component of the impeller noise was increased correspondingly. This change in the level of the noise component of the primary impeller frequency was measured as shown by the solid-line curve in FIG. 21. It will be seen that the described embodiment of the invention exhibits a remarkably reduction in the noise, proving the superior noise suppressing effect of the invention. The experiment was conducted with an arrangement schematically illustrated in FIG. 20, using a vapor relief extension passage 1166 constituted by an iron pipe having an inside diameter of 6 mm and a length of 160 mm and connected to the vapor relief port 1135. Although not shown, the ironpipe was secured to the pump housing by a resin band, thus attaining a higher strength.

Figure 22:
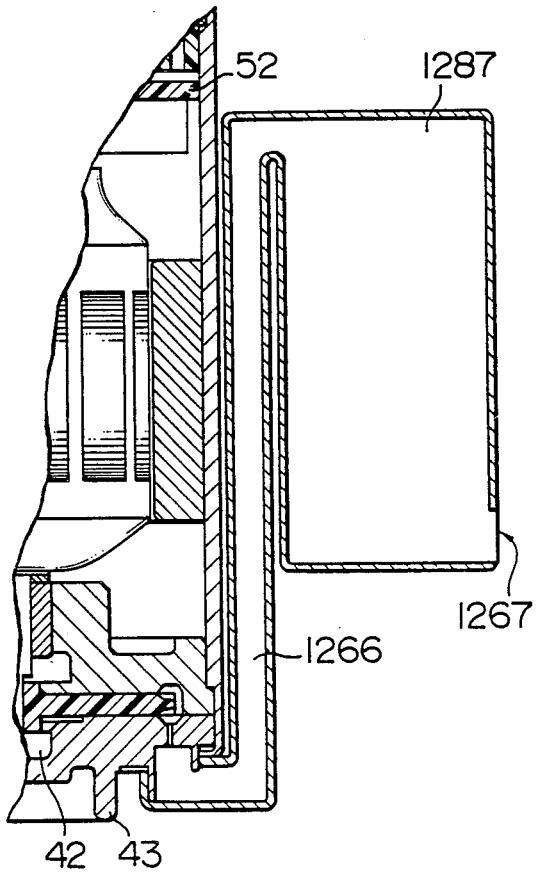
FIG. 22 is a fragmentary vertical sectional view of the fuel pump in accordance with the thirteenth embodiment of the invention.

FIG. 22 shows the thirteenth embodiment of the invention which is basically the same as embodiment shown in FIG. 21, but is distinguished therefrom in that it has an expansion chamber 1287 connected to the upper end of the vapor relief extension passage 1266 and having sufficiently large cross-sectional area and volume as compared with the extension passage. The expansion chamber 1287 is directed downwardly from the upper end of the vapor extension passage 1266, and is provided at the lower end thereof with a vapor outlet opening 1267. According to this arrangement, since a certain amount of fuel remains in the expansion chamber 1287 even after the whole portion of the vapor relief extension passage 1266 has been immersed in the fuel, the noise transmitted from the impeller is transmitted through the air without fail, so that a remarkable noise suppressing effect can be obtained. It will be seen that the thirteenth embodiment described hereinbefore stably provides an appreciable noise suppressing effect regardless of the fuel level in the fuel tank.

In the twelfth and thirteenth embodiments described hereinbefore, the pipe constituting the vapor relief extension passage may be made from a metal or a resin, and the connection between the extension passage and the fuel pump as a whole may be attained by any suitable connecting construction such as caulking, fitting and riveting, as well as bonding which is used in the described cases.

As will be understood from the foregoing description, according to the invention, it is possible to effectively attenuate the noise produced from the region around the impeller by a simple construction which employs a vapor relief extension passage provided outside the pump chamber and connected to the vapor relief port, thereby enabling the production of a fuel pump which operates with reduced noise.

Since the principle of the invention is based upon attenuation of the noise along the path of transmission of the noise, the noise suppression can be attained without requiring any change in the construction of the impeller and the pump chamber which would deteriorate the performance of the fuel pump.

Although the invention has been described through specific terms, it is to be noted that the described embodiment is only illustrative and various changes and modifications may be imparted thereto without departing from the scope of the invention which is limited solely by the appended claims. For instance, the present invention can apply not only to an automotive fuel pump as described but also to other kinds of fuel pumps such as a fuel pump for feeding a fuel to a heater of an air conditioner.

What is claimed is:

1. A fuel pump mounted in a fuel tank for delivering a fuel from said fuel tank, said fuel pump comprising:

a pump housing which defines a pump chamber having a suction port and a delivery port;

an impeller rotatably disposed in said pump chamber and provided on an outer periphery thereof with a multiplicity of blades formed thereon;

driving means for rotatingly driving said impeller so as to enable said impeller to suck said fuel through said suction port and pressurize and deliver the same through said delivery port;

vapor relief port means formed a wall of said pump housing to discharge vapor of fuel generated as a result of rotation of said impeller from said pump chamber into a space in said fuel tank; and vapor relief extension passage means connected to said vapor relief port means and opening in the space in said fuel tank, the total length of said vapor relief port means and said vapor relief extension passage means being substantially 15 mm or greater, said vapor relief extension passage means having an outlet which is at least as large in cross-sectional opening area as other passage portions of said vapor relief extension passage means, whereby pulsating components carried by the fuel vapor and liquid fuel discharged through said vapor relief port means are attenuated as said vapor and liquid fuel travels along said vapor relief extension passage means, whereby impeller noise is suppressed remarkably.

2. A fuel pump according to claim 1, wherein said vapor relief extension passage means is constituted by a groove formed in an outer surface of said pump housing and a covering member which covers said groove along the surface of said pump housing.

3. A fuel pump according to claim 2, wherein the groove formed in said pump housing has an arcuate form which extends in a direction of rotation of the impeller from a portion at which said groove is connected to said vapor relief port means to a portion at which said groove opens into the space in said fuel tank.

4. A fuel pump according to claim 2, wherein said covering member is constituted by a cushion rubber which is interposed between said fuel pump and a member for supporting said fuel pump, so as to prevent transmission of vibration.

5. A fuel pump according to claim 2, wherein said vapor relief extension passage means has an enlarged portion at an intermediate portion thereof between a portion connected to said vapor relief port means and a portion at which it opens into the space in said fuel tank.

6. A fuel pump according to claim 1, wherein said vapor relief extension passage means is constituted by a groove formed in a covering member secured to an outer surface of said pump housing, said groove being communicated with said vapor relief port means, and the surface of said pump housing.

7. A fuel pump according to claim 6, wherein said groove formed in said covering member has an arcuate form and extends in a direction of rotation of said impeller from a portion at which it is connected to said vapor relief port means to a portion at which it opens into the space in said fuel tank.

8. A fuel pump according to claim 6, wherein said covering member is constituted by a cushion rubber interposed between said fuel pump and a supporting member of said fuel pump so as to prevent transmission of vibration.

9. A fuel pump according to claim 1, wherein said vapor relief extension passage means includes a pipe which is fixed to said pump housing and connected to said vapor relief port means.

10. A fuel pump according to claim 9, wherein said vapor relief extension passage means includes a rigid pipe fixed to said pump housing and connected to said vapor relief port means, and an elastic pipe connected to a free end of said rigid pipe.

11. A fuel pump according to claim 1, wherein said vapor relief extension passage means is constituted by a bore formed to extend through a cushion rubber interposed between said pump housing and a member supporting said fuel pump housing for preventing transmission of vibration.

12. A fuel pump according to claim 1, wherein said vapor relief extension passage means extends upwardly so that its opening to the space of said fuel tank is spaced from a wall of said fuel tank.

13. A fuel pump according to claim 12, wherein the opening of said vapor relief extension passage means is located above said fuel pump at the lowest.

14. A fuel pump according to claim 12, wherein said vapor relief extension passage means is provided with an expansion chamber connected to an upper end thereof, said expansion chamber being directed downwardly from a portion thereof at which it is connected to the upper end of said vapor relief extension passage means, and said expansion chamber being provided in a lower side wall thereof with an opening, so that said vapor relief expansion passage means is communicated with the space in said fuel tank through the opening of said expansion chamber.

15. A fuel pump as in claim 1, wherein said vapor relief extension passage means is of a substantially uniform cross-sectional area over the entire length thereof.

16. A fuel pump mounted in a fuel tank to deliver a fuel from the inside to the outside of said fuel tank, said fuel pump comprising:

a pump section including a regenerative type pump constituted by a pump housing defining a pump chamber with a suction port and a deliver port, and an impeller rotatably disposed in said pump chamber and provided with a multiplicity of blades formed on an outer periphery thereof;

a driving section for driving said impeller so as to enable said impeller to suck said fuel from said suction port and to pressurize and deliver the same through said delivery port;

a cylindrical casing encasing said pump section and said rotary driving section;

vapor relief port means formed through a wall of said pump housing for relieving vapor of fuel generated in said pump housing into a space in said fuel tank; and vapor relief extension passage means connected at its one end to said vapor relief port means and opening at its other end in parallel with said wall of said pump housing in the space in said fuel tank, said vapor relief extension passage means extending in an arcuate form in a direction of rotation of said impeller from said one end to said other end, the total length of a path constituted by said vapor relief port means and said vapor relief extension passage means being substantially at least 15 mm, said vapor relief extension passage means having an outlet which is at least as large in cross-sectional opening area as other passage portions of said vapor relief extension passage means.

17. A fuel pump as in claim 16, wherein said vapor relief extension passage means is of a substantially uniform cross-sectional area over the entire length thereof.

18. A fuel pump mounted in a fuel tank for delivering a fuel from said fuel tank, said fuel pump comprising:

a pump housing which defines a pump chamber having a suction port and a delivery port;

an impeller rotatably disposed in said pump chamber and provided on an outer periphery thereof with a multiplicity of blades formed thereon;

driving means for rotatingly driving said impeller so as to enable said impeller to suck said fuel through said suction port and pressurize and deliver the same through said delivery port;

vapor relief port means formed in a wall of said pump housing to discharge vapor of fuel generated as a result of rotation of said impeller from said pump chamber into a space in said fuel tank; and vapor relief extension passage means connected to said vapor relief port means and opening in the space in said fuel tank, the total length of said vapor relief port means and said vapor relief extension passage means being substantially 28 mm or greater, said vapor relief extension passage means having an outlet which is at least as large in cross-sectional opening area as other passage portions of said vapor relief extension passage means, whereby pulsating components carried by the fuel vapor and liquid fuel discharged through said vapor relief port means are attenuated as said vapor and liquid fuel travels along said vapor relief extension passage means, whereby impeller noise is suppressed remarkably.

19. A fuel pump as in claim 18, wherein said vapor relief extension passage means is of a substantially uniform cross-sectional area over the entire length thereof.

20. A fuel pump mounted in a fuel tank to deliver a fuel from the inside to the outside of said fuel tank, said fuel pump comprising:

a pump section including a regenerative type pump constituted by a pump housing defining a pump chamber with a suction port and a delivery port, and an impeller rotatably disposed in said pump chamber and provided with a multiplicity of blades formed on an outer periphery thereof;

a driving section for driving said impeller so as to enable said impeller to suck said fuel from said suction port and to pressurize and deliver the same through said delivery port;

a cylindrical casing encasing said pump section and said rotary driving section;

vapor relief port means formed through a wall of said pump housing for relieving vapor of fuel generated in said pump housing into a space in said fuel tank; and vapor relief extension passage means connected at its one end to said vapor relief port means and opening at its other end in parallel with said wall of said pump housing in the space in said fuel tank, said vapor relief extension passage means extending in an arcuate form in a direction of rotation of said impeller from said one end to said other end, the total length of a path constituted by said vapor relief port means and said vapor relief extension passage means being substantially at least 28 mm, said vapor relief extension passage means having an outlet which is at least as large in cross-sectional opening area as other passage portions of said vapor relief extension passage means.

21. A fuel pump as in claim 20, wherein said vapor relief extension passage means is of a substantially uniform cross-sectional area over the entire length thereof.

* * * * *